US010141080B2

(12) United States Patent
Vose et al.

(10) Patent No.: US 10,141,080 B2
(45) Date of Patent: Nov. 27, 2018

(54) INSOLUBLE CESIUM GLASS

(71) Applicant: ILLINOIS TOOL WORKS INC., Glenview, IL (US)

(72) Inventors: Mark W. Vose, Windham, NH (US); Mark Shilton, Chelmsford, MA (US)

(73) Assignee: QSA GLOBAL, INC., Burlington, MA (US)

( * ) Notice: Subject to any disclaimer, the term of this patent is extended or adjusted under 35 U.S.C. 154(b) by 116 days.

(21) Appl. No.: 15/118,192

(22) PCT Filed: Feb. 11, 2015

(86) PCT No.: PCT/US2015/015458

§ 371 (c)(1),
(2) Date: Aug. 11, 2016

(87) PCT Pub. No.: WO2015/183351

PCT Pub. Date: Dec. 3, 2015

(65) Prior Publication Data

US 2017/0178760 A1 Jun. 22, 2017

Related U.S. Application Data

(60) Provisional application No. 61/941,210, filed on Feb. 18, 2014, provisional application No. 61/954,677, filed on Mar. 18, 2014.

(51) Int. Cl.
*G21G 4/04* (2006.01)
*G21G 4/00* (2006.01)

(52) U.S. Cl.
CPC ..... *G21G 4/04* (2013.01); *G21G 4/00* (2013.01); *G21Y 2004/10* (2013.01)

(58) Field of Classification Search
None
See application file for complete search history.

(56) References Cited

U.S. PATENT DOCUMENTS

| | | | | |
|---|---|---|---|---|
| 3,114,716 | A | 12/1963 | Quinby | |
| 3,196,106 | A * | 7/1965 | Haden, Jr. | G21F 9/12 210/682 |
| 3,330,697 | A | 7/1967 | Pechini | |
| 3,567,646 | A | 3/1971 | Gray | |
| 4,224,177 | A | 9/1980 | Macedo et al. | |
| 4,808,318 | A * | 2/1989 | Komarneni | G21F 9/12 210/682 |
| 8,969,646 | B2 * | 3/2015 | Shin | C04B 33/1324 588/20 |
| 2014/0114112 | A1 * | 4/2014 | Shin | C04B 33/1324 588/10 |

OTHER PUBLICATIONS

ISR and WO for PCT/US2015/015458 dated Nov. 12, 2015.

* cited by examiner

*Primary Examiner* — Joseph D Anthony
(74) *Attorney, Agent, or Firm* — McCarter & English, LLP

(57) ABSTRACT

The present disclosure relates to an insoluble cesium mixed multimetal oxide, ceramic, glass-ceramic or glass which is intended to be a replacement for cesium chloride or similar materials used as radiation sources. Additionally, this insoluble compound could replace other insoluble lower specific activity cesium compounds used in industrial, underwater, and underground/downhole application because it would allow the use of older lower specific activity cesium stock solutions. The disclosure further provides a method for the cesium to be recovered from cesium chloride sources.

31 Claims, 2 Drawing Sheets outer inner insert isotope

INSOLUBLE CESIUM GLASS

This application is a National Phase of International Application No. PCT/US2015/015458, filed Feb. 11, 2015, and, claims priority under 35 U.S.C. § 119(e) of U.S. provisional patent application 61/941,210, filed on Feb. 18, 2014, and U.S. provisional patent application 61/954,677, filed on Mar. 18, 2014, the disclosures of both of which are hereby incorporated by reference in their entirety.

BACKGROUND OF THE DISCLOSURE

Field of the Disclosure

The present disclosure relates to an insoluble cesium glass ceramic which is intended to be a replacement for cesium chloride or similar materials used as radiation sources.

Description of the Prior Art

Cesium-137 chloride is used as a radiation source in many different applications, such as, but not limited to, medical and industrial (gaging) applications. Cesium-137 chloride typically has a specific activity of 100 Curies per cubic centimeter and is used in hospitals and universities across the world. In the United States alone there are at least 1300 high activity cesium chloride sources in use. As cesium chloride is soluble in water, it can present difficult radiological challenges. At least three European countries have banned the use of cesium chloride radiological sources. The National Research Council has recommended Congress and the NRC to stop licensing new cesium chloride sources and provide incentives for users to trade out their in-use or spent sources. The committee report notes that although less hazardous forms of cesium exist, none are commercially available.

While cesium-137 chloride's specific activity is approximately 2.98 gCs/cc, its effective specific activity can only be 20-30% less because it undergoes a phase transition at 451° Centigrade which results in a 17% increase in volume.

In 2011, a new application for cesium niobate was devised (Solid-State Photocatalysts). The Department of Energy researchers devised a medium temperature synthesis method to produce cesium niobate using a Sol-Gel technique.

Related prior art includes U.S. Pat. No. 3,330,697 entitled "Method of Preparing Lead and Alkaline Earth Titanates and Niobates and Coating Method Using the Same to Form a Capacitor", issued on Jul. 11, 1967 to Pechini and U.S. Pat. No. 3,567,646 entitled "Stable Cesium Compounds", issued on Mar. 2, 1971 to Gray.

Protocols of interest are described in:

1. E. R. Camargo and M. Kakihana, *Low Temperature Synthesis of Lithium Niobate Powders Based on Water-soluble Niobium Malato Complexes*, Solid State Ionics 151 (2002), 413-418.

2. V. Bouquet, E. Lono, E. R. Leite and J. A. Varela, *Influence of Heat Treatment on $LiNbO_3$ Thin Films Prepared on Si*(111) *by the Polymeric Precursor Method*, Journal of Material Research 14 (1999), 3115-3121.

3. *Progress in Solid State Chemistry Research*, edited by Ronald W. Buckley, published by Nova Science Publishers, Inc., 2007, Chapter 3, pages 117-164, entitled *Precursors Routes for the Preparation of Nb-Based Multimetallic Oxides* authored by D. A. Bayot and M. M. Devillers.

4. E. R. Camargo and M. Kakihana, *Chemical Synthesis of Lithium Niobate Powders* (*LiNbo*3) *Prepared from Water-Soluble Dl-Malic Acid Complexes*, Chemical Materials (2001) 13, 1905-1909.

5. Robert W. Smith, Wai-Ning Mei, Renat Sabirianov, *Novel Photocatalytic Metal Oxides*, D.O.E. Hydrogen and Fuel Cells Program, FY 2011 Annual Progress Report, 170-172.

6. L. H. Wang, D. R. Yuan, X. L. Duan, X. Q. Wang and F. P. Yu, *Synthesis and Characterization of Fine Lithium Niobate Powders by Sol-Gel Method*, Crys. Res. Technol. 42, No. 4, 321-324 (2007).

OBJECTS AND SUMMARY OF THE DISCLOSURE

It is therefore an object of the present disclosure to provide cesium-137 radiological sources with increased radiological safety, in particular, decreased solubility in water.

This and other objects are attained by providing radiological sources based on cesium niobate or cesium tantalate and improved fabrication methods therefor. Cesium niobate or cesium tantalate offer partial cesium densities around 2.43 gCs/cc compared with cesium chloride of 2.55 gCs/cc (above the 451° Centigrade phase transition temperature) and both the tantalate and niobate are extremely insoluble. Cesium niobate and tantalate have been considered and rejected in the past as candidate cesium compounds because fabrication is through solid-state reactions from the metal oxides ($Cs_2O$ & $Nb_2O_5$ or $Ta_2O_5$) which require several days of heating at high temperature and with several intermediate grinding stages. The use of high temperatures and long heating times before the cesium is chemically bonded can lead to large losses of volatile cesium which can cause major radiological problems in the production plant.

Prior art cesium glass is highly insoluble and mechanically robust. However, the cesium glass is very complicated to produce and has lower specific activity than CsCl, $CsNbO_3$ or $CsTaO_3$. Switching to cesium niobate or cesium tantalate could dramatically lower manufacturing costs while increasing manufacturing output. Additionally, cesium niobate or cesium tantalate powder could be manufactured in the United States and pelletized via uniaxial cold compaction and sintering or direct melting, or other source manufacturing method which achieves theoretical densities near 100 percent.

BRIEF DESCRIPTION OF THE DRAWINGS

Further objects and advantages of the disclosure will become apparent from the following description and from the accompanying drawing, wherein.

DETAILED DESCRIPTION OF THE PREFERRED EMBODIMENT

Figure 1:
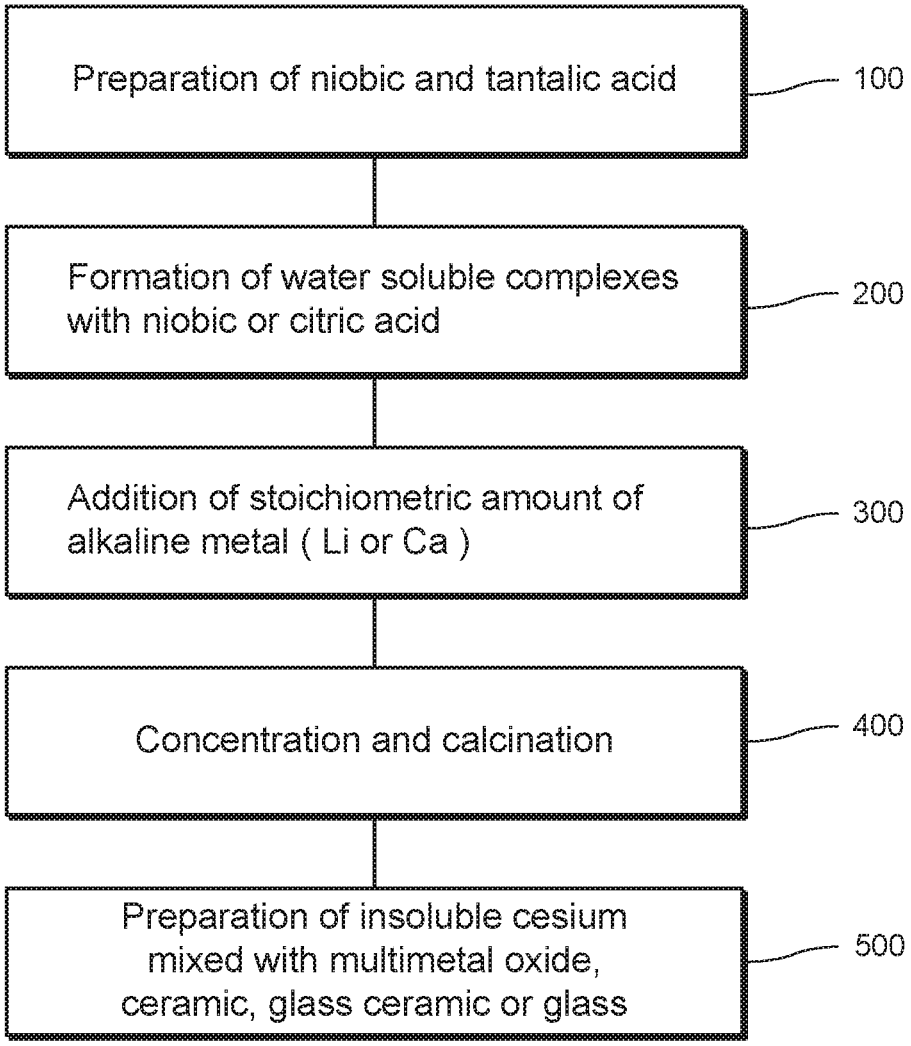
FIG. 1 is a flowchart outlining the disclosed processes.

Various methods are available for the production of components for insoluble cesium glass ceramic or other similar materials such as low solubility refractory material or pressed powder compact. In all of the methods described herein, cesium-137 compounds are envisioned to be used for the production of commercial products, while cesium-133 (i.e., naturally occurring cesium) compounds may be used to confirm the chemical protocols while reducing or eliminating the radiological risk. Additionally, while the use of nobium and tantalum is disclosed in these methods, it is envisioned that these methods may be applicable to other five-valent metals, such as, but not limited to, vanadium or combinations of five-valent metals.

Summary of First Method—Malate Complex Method

The procedure typically begins with addition of $Nb_2O_5$ oxide pentahydrate ($Nb_2O_5.5H_2O$) or, an equivalent compound, niobic acid ($2\times(HNbO_3.2H_2O)$) (in some instances, particularly while establishing chemical protocols, ten grams) to an aqueous solution (0.35 M) of oxalic acid (OA) in a 4:1 mass ratio of oxalic acid to $Nb_2O_5$ oxide pentahydrate or niobic acid. The resulting mixture is stirred for 5 hours at the boiling point until all $Nb_2O_5$ oxide pentahydrate or niobic acid dissolves, and is then filtered. The filtrate is treated with concentrated (i.e., typically in at least the 25-35 percent range) ammonium hydroxide to a pH of 11 to produce a precipitate of hydrated niobium oxide. The precipitate is then washed with 10% ammonium hydroxide to remove substantially all oxalate ions. The solid that results (assumed to be a quantitative recovery of $Nb_2O_5$ in the form of hydrolysed precipitate $Nb_2O_5.nH_2O$, also referred to as niobic acid, in a hydrated oxide form) is dissolved in a 0.1 moles per liter solution of racemic (has equal amounts of left- and right-handed enantiomers) malic acid (MA) in a 2:1 molar ratio of MA to $Nb_2O_5$. After stirring the solution for 5 hours at 70° Centigrade, and filtering it at 25° Centigrade, a portion may be analyzed for niobium content. Then $Li_2CO_3$ is added to one half of the Nb-malic solution in an equimolar ratio, and $Cs_2CO_3$ is added to the other half, also in an equimolar ratio. The two separate mixtures are then stirred for 2 hours under a stream of nitrogen at 80° Centigrade, and then evaporated under a stream of nitrogen at 80° Centigrade without further stirring until dry. The two solids that result are each heated at 550° Centigrade for 6 hours in an oven. With the initial provision of 30 grams of $Nb_2O_5$, a typical expected yield is at least 10 grams each of $LiNbO_3$ and $CsNbO_3$. The resulting product may be analyzed for niobium content as well as for either lithium or cesium content. Water content may also be analyzed. Larger batch sizes may require increased heating times and/or temperatures.

For a variation of this method, with a view to producing $CsTaO_3$, a quantity of $Ta_2O_5$ is provided and the above method is performed, except that the entire Ta-malic solution is treated with $Cs_2CO_3$. For example, starting with 25 grams of $Ta_2O_5$, it may be expected that at least 10 grams of $CsTaO_3$ is produced.

It should be noted that substitutions may be made for the ammonium hydroxide to adjust the pH to 11. Other aqueous-soluble organic or inorganic bases that do not contain interfering metal cations may be used. Those skilled in the art, after review of the present disclosure, will recognize that such materials as choline hydroxide solution, diethyldimethyl-ammonium hydroxide solution and similar solutions may be used.

Summary of Second Method—Citrate Complex Method

The method for fresh preparation of $Nb_2O_5$ includes the addition of 10 grams of $Nb_2O_5$ oxide pentahydrate or an equivalent compound, niobic acid, to an aqueous solution (0.35 M) of oxalic acid (OA) in a 4:1 mass ratio of OA to $Nb_2O_5$ oxide pentahydrate or niobic acid. The resulting mixture is stirred for 5 hours at the boiling point until all $Nb_2O_5$ oxide pentahydrate or niobic acid dissolves, and then filtered. The filtrate is treated with concentrated (i.e., typically in the 25-35 percent range) ammonium hydroxide to a pH of 11 to produce a precipitate of hydrated niobium oxide. The precipitate is then washed with 10% ammonium hydroxide to remove all oxalate ions. The solid that results (assumed to be a quantitative recovery of $Nb_2O_5$ in the form of hydrolysed precipitate $Nb_2O_5.nH_2O$, also referred to as niobic acid, in a hydrated oxide form) is then dissolved in a solution of citric acid (CA, also known as hydrogen citrate) in a 3:1 molar ratio of CA to $Nb_2O_5$. After heating the solution to 80° Centigrade, and filtering it at 25° Centigrade, a portion may be analyzed for niobium content. Then $Li_2CO_3$ is added to one half of the Nb-citric solution in an equimolar ratio of Nb to Li, and $Cs_2CO_3$ is added to the other half, in an equimolar ratio of Nb to Cs. For each of the two separate mixtures, ethylene glycol (EG) (or similar alcohol) is added in a 60:40 mass ratio of EG to total amount of citric acid or hydrogen citrate used, and the mixtures are stirred for 2 hours under a stream of nitrogen at 110° Centigrade, and then evaporated under a stream of nitrogen at 110° Centigrade without stirring until no significant further reduction in volume is observed (ethylene glycol boils 196-198° Centigrade and so, typically, most of it is not evaporated under these conditions). The two mixtures that result are each heated with an oil bath at 225-250° Centigrade for 2 hours in an open beaker under a stream of nitrogen, and then at 550° Centigrade for 6 hours in an oven. For example, starting with 30 grams of $Nb_2O_5$, it may typically be expected that at least 10 grams each of $LiNbO_3$ and $CsNbO_3$ would be produced. Larger batch sizes may require increased heating times and/or temperatures.

For a variation of this method, with a view to producing $CsTaO_3$, a quantity of $Ta_2O_5$ is provided and the above method is performed, except that the entire Ta-citric solution is treated with $Cs_2CO_3$. For example, starting with 25 grams of $Ta_2O_5$, it may be expected that at least 10 grams of $CsTaO_3$ is produced.

It should be noted that, as described above for the first method, that substitutions may be made for the ammonium hydroxide to adjust the pH to 11. Other aqueous-soluble organic or inorganic bases that do not contain interfering metal cations may be used. Those skilled in the art, after review of the present disclosure, will recognize that such materials as choline hydroxide solution, diethyldimethylammonium hydroxide solution and similar solutions may be used. Similarly, those skilled in the art, after review of this disclosure, may find other alcohols may be substituted for ethyl glycol, such as, but not limited to, methanol, diethylene glycol, triethylene glycol or tetraethylene glycol.

It is important to note that while masses (e.g., grams) and volumes (e.g., liters, milliliters) are recited in this disclosure, that it is expected that proportionally larger quantities can be used in industrial or other processes. Similarly, while manual laboratory steps are disclosed, these steps can be implemented as large scale industrial processes, as would be known to one skilled in the art, after review of the present disclosure. Similarly, while the following laboratory steps include both the malate complex method and the citrate complex method for experimental purposes, it is envisioned that any industrial process will use either the malate complex method or the citrate complex method. Similarly, in some instances, heating temperatures and times may be varied with the volume of material treated in the laboratory or industrial step.

The description is divided in five sections:

Section 1: Preparation of fresh niobic acid and tantalic acid.

Section 2: Preparation of water soluble Nb complexes with malic or citric acid.

Section 3: Preparation of water soluble Ta complexes with malic or citric acid.

Section 4: Preparation of $CsNbO_3$, $LiNbO_3$, and $CsTaO_3$ by the two methods studied.

Section 5: Preparation of insoluble cesium mixed multi-metal oxide, ceramic, glass-ceramic or glass from the material resulting from Section 4.

In section 1, fresh niobic acid and tantalic acid are obtained from the corresponding oxalate solution by precipitation with concentrated ammonium hydroxide ($NH_4OH$).

For procedure no. 1, niobium (valence V) oxalate hydrate [Nb(C10O20H5).xH2O] with a Niobium content of 19.1 percent is obtained. Niobium (valence V) oxalate hydrate (166 grams, 341 mmol of Nb) is dissolved in 1.5 liters of water at room temperature. The addition of $NH_4OH$ (100 mL, until basic) is expected to produce the precipitation of a white solid. The mixture is stirred for 15 minutes and the solid is collected by filtration. The solid is washed with 10% $NH_4OH$ (2×100 mL) and is allowed to stand overnight. The resulting wet niobic acid is used in the complexation procedures (procedures nos. 3 and 5) without further purification. It is assumed that 100% of the niobium is recovered and is transferred to the following steps.

For procedure no. 2, a tantalum (valence V) oxalate solution is obtained with a Ta content of 192 grams of $Ta_2O_5$ per liter of solution and a density 1.2 g/cm$^3$). Tantalum (valence V) oxalate solution (500 grams, 362 mmol of Ta) is diluted to 1.5 liter with water at room temperature. The addition of $NH_4OH$ (100 mL, until basic) produces the precipitation of a white solid. The mixture is stirred for 15 minutes and the solid is collected by filtration. The solid is washed with 10% $NH_4OH$ (2×100 mL) and is allowed to stand overnight. The resulting wet tantalic acid (2×($HTaO_3.2H_2O$) is used in the complexation procedures (see procedures nos. 4 and 6) without further purification. It is assumed that 100% of the tantalum is recovered and is transferred to the following steps.

In section 2, the solid obtained in procedure no. 1 is divided into two equal amounts which were used to prepare soluble Nb complexes with malic or citric acid.

For procedure no. 3, relating to the niobium malate complex solution, freshly prepared wet niobic acid (half of the product of procedure no. 1, ca 170 mmol of Nb) is suspended in a solution of malic acid (45.6 grams, 340 mmol, 2 mol equivalent) in three liters of water. The suspension is heated to 85° Centigrade (oil bath temperature) and is kept at that temperature for 4 hours (most of the solid dissolves when the bath temperature reaches 65° Centigrade). The resulting solution is allowed to cool to room temperature overnight and is filtered through Celite (40 grams, washed with 50 mL water).

A small portion of the niobium malate solution (5 mL) may be analyzed for Nb content. A typical result is 55.5 mM of Nb concentration, with a yield of 3.06 liters and a 170 mmol recovery (100 percent).

In procedure no. 4, relating to niobium citrate complex solution, freshly prepared wet niobic acid (half of the product of the first procedure, ca 170 mmol of Nb) is suspended in a solution of citric acid (98 grams, 510 mmol, 3 mol equivalent, Sigma-Aldrich) in three liters of water. The suspension is heated to 90° Centigrade (oil bath temperature) and is kept at that temperature for 4 hours (most of the solid dissolved when the bath temperature reached 65° Centigrade). The resulting solution is allowed to cool to room temperature overnight and is filtered through Celite (40 grams, washed with 50 mL water).

A small portion of the niobium citrate solution (5 mL) may be analyzed for Nb content. A typical result is 53.1 mM of Nb concentration, with a yield of 3.13 liters and a 166 mmol recovery (98 percent).

The solution is used in procedures nos. 10 and 11 to produce Cs and Li niobates respectively.

In section 3, the solid obtained in procedure no. 2 is divided into two equal amounts which are used to prepare soluble Ta complexes with malic or citric acid.

For procedure no. 5, relating to tantalum malate complex solution, freshly prepared wet tantalic acid (half of the product of procedure no. 2, ca 181 mmol of Ta) is suspended in a solution of malic acid (48.5 grams, 362 mmol, 2 mol equivalent, Sigma-Aldrich) in 3 liters of water. The suspension is heated at reflux for 18 hours. A substantial amount of solid may remain undissolved. The resulting suspension is allowed to cool to room temperature. The mixture is allowed to stand overnight at room temperature. The liquid is decanted away to produce a turbid solution of tantalum malate complex.

A small portion of the solution (5 mL) is centrifuged (2×5 minutes at 4400 rpm) and the supernatant is filtered through a syringe filter (0.45 μm). The resulting almost clear solution may be analyzed for Ta content. A typical result is 49.8 mM of Ta concentration, with a yield of 3.15 liters and a 157 mmol recovery (87 percent).

The turbid solution is used in procedure no. 9 to produce Cs tantalate.

In procedure no. 6, relating to tantalum citrate complex solution, freshly prepared wet tantalic acid (half of the product of procedure no. 2, or approximately 181 mmol of Ta) is suspended in a solution of citric acid (104.3 g, 543 mmol, 3 mol equivalent, Sigma-Aldrich) in three liters of water. The suspension is heated at reflux for 4 hours. A substantial amount of solid remained undissolved. The resulting solution is allowed to cool to room temperature overnight. The mixture is allowed to stand overnight at room temperature. The liquid is decanted away to produce a turbid solution of tantalum citrate complex.

A small portion of the solution (5 mL) is centrifuged (2×5 minutes at 4400 rpm) and the supernatant is filtered through a syringe filter (0.45 μm). The resulting almost clear solution may be analyzed for Ta content. A typical result is 39.6 mM of Ta concentration, with a yield of 3.35 liters and a 133 mmol recovery (73 percent).

The turbid solution is used in procedure no. 12 to produce Cs tantalate.

In section 4, the solutions described in sections 2 and 3 are combined with stoichiometric amounts of $Cs_2CO_3$ or $Li_2CO_3$ and heated to 550° Centigrade to produce the corresponding Cs and Li niobates and tantalates.

In procedure no. 7, relating to $CsNbO_3$ from malate complex, half of the Nb-malate complex solution (1.53 L, 84.9 mmol) is transferred to a 3 liter round bottom flask and one molar equivalent of $Cs_2CO_3$ (13.83 grams, 42.45 mmol, Strem) is added. The resulting solution is stirred at 75-80° Centigrade (bath temperature) for 2 hours. The solution is then transferred in portions to a one liter beaker, and is concentrated at 80-85° Centigrade (bath temperature) aided by a nitrogen stream to facilitate evaporation. The residue is transferred, with the aid of a small amount of water, to a smaller beaker (250 mL) and the concentration is continued.

The resulting white solid is heated in the same beaker at 550° Centigrade for 6 hours. Initially, it is expected that the solid turns black and then most of the color disappears. The residue is allowed to cool overnight in a desiccator, and is crushed with a mortar and pestle. The resulting powder is heated at 550° Centigrade for an additional 3 hours, and allowed to cool overnight in a desiccator. After crushing with a mortar and pestle, the resulting gray solid is bottled. A yield of 22.53 grams (97%) is typically achieved.

A first sample (such as 200 mg) may be analyzed for Nb, Cs, and water content with, typically, the following results.

| Elemental Analysis | Observed | Calculated for $CsNbO_3$ |
|---|---|---|
| Cs | 44.0% | 48.54% |
| Nb | 33.0% | 33.93% |
| $H_2O$ | 0.928% | — |

In procedure no. 8, relating to $LiNbO_3$ from malate complex, half of the Nb-malate complex solution (1.53 liter, 84.9 mmol) is transferred to a 3 liter round bottom flask and one molar equivalent of $Li_2CO_3$ (3.14 grams, 42.45 mmol, Strem) is added. The resulting solution is stirred at 75-80° Centigrade (bath temperature) for 2 hours. The solution is then transferred in portions to a 1 liter beaker, and is concentrated at 80-85° Centigrade (bath temperature) aided by a nitrogen stream to facilitate evaporation. The residue is transferred, with the aid of a small amount of water, to a smaller beaker (250 mL) and the concentration is continued.

The resulting white solid is heated in the same beaker at 550° Centigrade for 6 hours. Initially, it is expected that the solid turns black and then most of the color disappears. The residue is allowed to cool overnight in a desiccator, and is crushed with a mortar and pestle. The resulting powder is heated at 550° Centigrade for an additional 3 hours, and allowed to cool overnight in a desiccator. After crushing with a mortar and pestle, the resulting gray solid is bottled. A yield of 11.78 grams (94 percent) is determined.

A first sample (such as 200 mg) may be analyzed for Nb, Li, and water content with, typically, the following results.

| Elemental Analysis | Observed | Calculated for $LiNbO_3$ |
|---|---|---|
| Li | 5.13% | 4.69% |
| Nb | 64.5% | 62.84% |
| $H_2O$ | 0.534% | — |

In procedure no. 9, relating to $CsTaO_3$ from malate complex, a portion of the Ta-malate complex solution (1.7 liters, 84.66 mmol) is transferred to a 3 liter round bottom flask and one molar equivalent of $Cs_2CO_3$ (13.79 grams, 42.33 mmol, Strem) is added. The resulting turbid solution is stirred at 75-80° Centigrade (bath temperature) for 2 hours. The solution is then transferred in portions to a one liter beaker, and is concentrated at 80-85° Centigrade (bath temperature) aided by a nitrogen stream to facilitate evaporation. The residue is transferred, with the aid of a small amount of water, to a smaller beaker (250 mL) and the concentration is continued.

The resulting white solid is heated in the same beaker at 550° Centigrade for 6 hours. Initially, it is expected that the solid turns black and then most of the color disappears. The residue is allowed to cool overnight in a desiccator, and is crushed with a mortar and pestle. The resulting powder is heated at 550° Centigrade for an additional 6 hours, and allowed to cool overnight in a desiccator. After crushing with a mortar and pestle, the resulting gray solid is bottled. A yield of 32.26 grams (105 percent) is determined.

A sample (such as 200 mg) may be analyzed for Ta, Cs, and water content with, typically, the following results.

| Elemental Analysis | Observed | Calculated for $CsTaO_3$ |
|---|---|---|
| Cs | 34.5% | 36.73% |
| Ta | 47.7% | 50.01% |
| $H_2O$ | 2.33% | — |

In procedure no. 10, relating to $CsNbO_3$ from citrate complex, half of the Nb-citrate complex solution (1.57 liters, 83.4 mmol) is transferred to a 3 liter round bottom flask and one molar equivalent of $Cs_2CO_3$ (13.59 grams, 41.7 mmol, Strem) is added. Ethylene glycol (73.5 grams, 1.5 times the amount of citric acid present) is added. Similar alcohols may be substituted for ethylene glycol. The resulting solution is stirred at 90-100° Centigrade (bath temperature) for 2 hours. The solution is then transferred in portions to a 1 liter beaker, and is concentrated at 90-100° Centigrade (bath temperature) aided by a nitrogen stream to facilitate evaporation. After most of the water is evaporated, the temperature of the oil bath is slowly increased to 215-225° Centigrade. The reaction mixture is expected to turn black and a heavy foam to be formed which requires careful monitoring to prevent losses of material. The residue is transferred, with the aid of a small amount of water, to a smaller beaker (250 mL) and the concentration is continued.

The resulting black gum is heated in the same beaker at 550° Centigrade for 6 hours. Initially, it is expected that the solid turns black and then most of the color disappears. The residue is allowed to cool overnight in a desiccator, and is crushed with a mortar and pestle. The resulting powder is heated at 550° Centigrade for additional 6 hours, and then 14 hours. After cooling overnight in a desiccator and crushing with a mortar and pestle, the resulting gray solid is bottled. A yield of 23.38 grams (98 percent) is typically determined.

A sample (such as 200 mg) may be analyzed for Nb, Cs, and water content with, typically, the following results.

| Elemental Analysis | Observed | Calculated for $CsNbO_3$ |
|---|---|---|
| Cs | 44.1% | 48.54% |
| Nb | 31.5% | 33.93% |
| $H_2O$ | 1.18% | — |

In procedure no. 11, relating to $LiNbO_3$ from citrate complex, half of the Nb-citrate complex solution (1.56 liters, 82.8 mmol) is transferred to a 3 liter round bottom flask and one molar equivalent of $Li_2CO_3$ (3.06 grams, 41.4 mmol, Strem) is added. Ethylene glycol (73.5 grams, 1.5 times the amount of citric acid present) is added. Similar alcohols may be substituted for ethylene glycol. The resulting solution is stirred at 90-100° Centigrade (bath temperature) for 2 hours. The solution is then transferred in portions to a 1 liter beaker, and is concentrated at 90-100° Centigrade (bath temperature) aided by a nitrogen stream to facilitate evaporation. After most of the water is evaporated, the temperature of the oil bath is slowly increased to 215-225° Centigrade. The reaction mixture is expected to turn black and a heavy foam to be formed which requires careful monitoring to prevent losses of material. The residue is transferred, with the aid of a small amount of water, to a smaller beaker (250 mL) and the concentration is continued.

The resulting black gum is heated in the same beaker at 550° Centigrade for 6 hours. Initially, it is expected that the solid turns black and then most of the color disappears. The residue is allowed to cool overnight in a desiccator, and is crushed with a mortar and pestle. The resulting powder is heated at 550° Centigrade for additional 6 hours, and then 14 hours. After cooling overnight in a desiccator and crushing with a mortar and pestle, the resulting gray solid is bottled. A yield of 12.05 grams (99 percent) is typically determined.

A sample (such as 200 mg) may be analyzed for Nb, Li, and water content with, typically, the following results.

| Elemental Analysis | Observed | Calculated for $LiNbO_3$ |
|---|---|---|
| Li | 4.96% | 4.69% |
| Nb | 63.9% | 62.84% |
| $H_2O$ | 0.511% | — |

In procedure no. 12, relating to $CsTaO_3$ from citrate complex, a portion of the Ta-citrate complex solution (2.1 L, 83.16 mmol) is transferred to a 3 liter round bottom flask and one molar equivalent of $Cs_2CO_3$ (13.55 grams, 41.58 mmol, Strem) is added. Ethylene glycol (97.5 grams, 1.5 times the amount of citric acid present) is added. Similar alcohols may be substituted for ethylene glycol. The resulting solution is stirred at 90-100° Centigrade (bath temperature) for 2 hours. The solution is then transferred in portions to a 1 liter beaker, and is concentrated at 90-100° Centigrade (bath temperature) aided by a nitrogen stream to facilitate evaporation. After most of the water is evaporated, the temperature of the oil bath is slowly increased to 215-225° Centigrade. The reaction mixture is expected to turn black and a heavy foam to be formed which requires careful monitoring to prevent losses of material. The residue is transferred, with the aid of a small amount of water, to a smaller beaker (250 mL) and the concentration is continued.

The resulting black gum is heated in the same beaker at 550° Centigrade for 6 hours. Initially, it is expected that the solid turns black and then most of the color disappears. The residue is allowed to cool overnight in a desiccator, and is crushed with a mortar and pestle. The resulting powder is heated at 550° Centigrade for additional 6 hours, and then 14 hours. After cooling overnight in a desiccator and crushing with a mortar and pestle, the resulting gray solid is bottled. A yield of 33.5 grams (111 percent) is typically determined.

A sample (such as 200 mg) may be analyzed for Ta, Cs and water content with, typically, the following results.

| Elemental Analysis | Observed | Calculated for $CsTaO_3$ |
|---|---|---|
| Cs | 32.0% | 36.73% |
| Ta | 45.8% | 50.01% |
| H2O | 0.536% | — |

CONCLUSIONS

Lithium niobate ($LiNbO_3$), cesium niobate ($CsNbO_3$), and cesium tantalate ($CsTaO_3$) are prepared through two methods. Each method requires four steps:

1. Preparation of niobic and tantalic acid. FIG. 1, element 100.
2. Formation of water soluble complexes with malic or citric acid. FIG. 1, element 200.
3. Addition of stoichiometric amounts of alkaline metals (Li or Cs). FIG. 1, element 300.
4. Concentration and calcinations. FIG. 1, element 400.

Both niobic and tantalic acid are prepared by precipitation of the corresponding oxalate complex aqueous solution by addition of concentrated ammonia. The resulting precipitate is collected by filtration and is used wet in step 2.

Niobic acid dissolved in the presence of 2 mol equivalents of malic acid or 3 mol equivalents of citric acid after heating the aqueous suspension at 65° Centigrade. In this case a clear solution is obtained. Nb analysis of the solution typically shows that the recovery is almost quantitative (98-100% for two steps).

Tantalic acid only partially dissolved in the same conditions (73-87% recovery for two steps). The residual solid could not be completely removed. The Ta content in the resulting turbid solution is determined and it is used on the following steps.

The niobium and tantalum complexes (which may be niobic or tantalic acids, or more broadly, hydrated or hydrolysed oxides) with malic acid are combined with stoichiometric amounts of $Li_2CO_3$ or $Cs_2CO_3$ and then proceeded to the next step. The carbonates are used to avoid the presence of chloride ions which might interfere with the proper formation and/or crystallization of the final niobates and tantalates.

In the case of the niobium and tantalum complexes with citric acid, ethylene glycol, or a similar alcohol, is added in addition to the Li and Cs salts.

The Li and Cs salts of the niobium and tantalum complexes with malic acid are concentrated by heating at 80-85° C. and a nitrogen stream. The evaporation of such large amounts of water required several days. The subsequent calcination of the resulting residues proceeded. Typically, very good apparent recovery can be expected (94-105%).

The evaporation of the Li and Cs salts of the niobium and tantalum complexes with citric acid presented some complications. Citric acid and ethylene glycol (or similar alcohol) form polymers upon heating. The resulting polymers typically causes the formation of a heavy sticky foam which has to be monitored to prevent material losses. The subsequent calcination of the resulting residues also required longer periods of time, probably due to the presence of larger amounts of carbon in the samples. Typically, very good apparent recovery is observed for these samples (98-110%).

The water content of the products is determined by a method, such as, but not limited to the Karl Fischer method. The samples are typically expected to show a low water content (0.5-2.3%).

The elemental analysis of the Cs salts typically shows values for the Cs, and Nb or Ta content slightly lower than calculated values (3-13%). This could be explained by the presence of residual amorphous carbon in the samples even after calcinations at 550° Centigrade. In all the cases the Cs content typically appears to be slightly lower that the Nb or Ta.

The elemental analysis of the Li salts typically shows values for the Li and Nb content slightly higher than the calculated values (2-9%).

The two methods tested provide large amounts of $CsNbO_3$ with similar characteristics such as elemental analysis and water content. Operationally, the malic acid method may be easier, in particular at the evaporation calcination steps.

The two methods also provide large amounts of $CsTaO_3$ with similar characteristics. The use of Ta instead of Nb caused some concerns due to the reduced solubility of the corresponding tantalic acid.

It is envisioned that the product can be provided in the form of a mixture, solid solution or ternary compound. Similarly, variations of the procedures are envisioned wherein a gel is produced in place of a precipitate.

For either method, Section 5 (FIG. 1, element 500) is required for the preparation of the insoluble cesium mixed metal oxide, ceramic, glass-ceramic or glass. The cesium nobiate or cesium tantalate powder (or similar powder) is to be densified to as close to the solid theoretical density as possible. Prior to processing the material, the cesium niobate, tantalate or mixture may be heated to 700° Centigrade to remove the amorphous carbon remaining after the 550° Centigrade treatment. A first method is cold or hot uniaxial compaction followed by pressureless sintering at 815° Centigrade. Alternately, direct melting of powder or a pellet of cesium niobate or tantalate or mixture thereof in a crucible, such as a platinum crucible at 940° Centigrade. Further alternatives include direct melting of the powder or pellet (of cesium niobate, tantalite or a mixture thereof) thereby forming compacts or shapes by pressing, sintering, melting, fusing or casting, with or without the addition of other stabilizing, wetting or glassy additives to make durable, low-solubility refractory inserts.

Figure 2D:
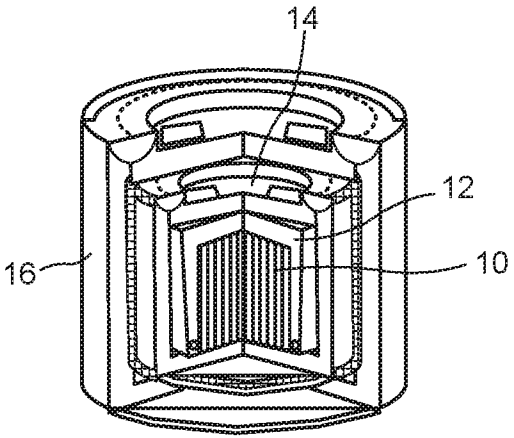
FIGS. 2A-2D are sequential perspective views, partly in cut-away, of a typical sequence of construction of a capsule using the product of the present disclosure.
Figure 2C:
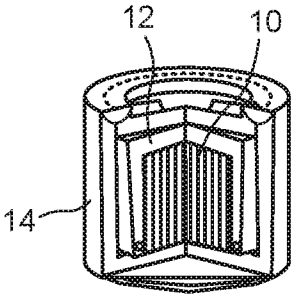
Figure 2B:
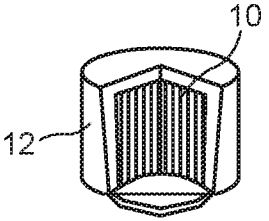
Figure 2A:
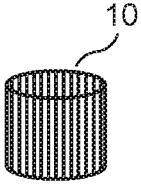

The melted material (element 10 of FIG. 2A which may be placed in an insert 12 as shown in FIG. 2B) or otherwise formed insert is used to fill a metallic capsule (FIG. 2C, element 14) with cesium niobate or tantalate or mixture thereof at near 100 percent density in the form of an insert 12. The capsule 14 is then sealed by welding (FIG. 2C) and then is typically overencapsulated at second time with an outer capsule (FIG. 2D, element 16). Those skilled in the art, after review of this disclosure, will recognize other methods of densification and encapsulation.

Thus the several aforementioned objects and advantages are most effectively attained. Although preferred embodiments of the invention have been disclosed and described in detail herein, it should be understood that this invention is in no sense limited thereby.

What is claimed is:

1. A cesium-137 gamma radiation source consisting of a mixed metal oxide of cesium-137 and a metal chosen from the group consisting of niobium, tantalum, vanadium and mixtures thereof, in which an insoluble radioactive product is formed, as a mixture, solid solution or ternary compound, by a process of reacting at least one dissolved compound of the at least one metal with a soluble cesium-137 compound followed by forming a solid radioactive component of a gamma radiation source.

2. The cesium-137 gamma radiation source of claim 1 wherein the radiation source is contained within a capsule.

3. The cesium-137 gamma radiation source of claim 1 wherein the solid radioactive component is formed by melting of a powder or pellet hereby forming compacts or shapes by pressing, sintering, melting, fusing or casting, to make low-solubility refractory inserts.

4. A method of producing a cesium-137 gamma radiation source of claim 1, the method including the steps of:

providing a hydrated oxide of a metal chosen from the group consisting of niobium, tantalum, vanadium and mixtures thereof;

forming water soluble complexes with the hydrated oxide;

adding stoichiometric amounts of cesium-137;

concentrating and calcinating a product from the step of adding stoichiometric amounts of alkaline metal.

5. A method of producing a cesium-137 gamma radiation source of claim 1, wherein the radiation source is produced by the method including the steps of:

adding $Nb_2O_5$ oxide pentahydrate or niobic acid to a solution of oxalic acid;

stirring and heating the combination of the $Nb_2O_5$ oxide pentahydrate or niobic acid and oxalic acid to dissolve the $Nb_2O_5$ oxide pentahydrate or niobic acid;

filtering the combination of the $Nb_2O_5$ oxide pentahydrate or niobic acid and oxalic acid to produce a filtrate:

treating the filtrate with a first aqueous soluble base to produce a precipitate;

washing the precipitate with a second aqueous soluble base to produce a first solid;

dissolving the first solid in malic acid to create a solution;

stirring the solution;

adding $^{137}Cs_2CO_3$ to the solution;

further stirring the solution; and evaporating the solution to create a second solid, wherein the second solid is the solid radioactive component.

6. The method of claim 5 wherein in the step of adding the $Nb_2O_5$ oxide pentahydrate or niobic acid to a solution of oxalic acid, approximately a four to one (4:1) mass ratio of oxalic acid to the $Nb_2O_5$ oxide pentahydrate or niobic acid is used.

7. The method of claim 5 wherein the step of treating the filtrate with a first aqueous soluble base results in a pH of approximately 11, and wherein the aqueous soluble base is ammonium hydroxide with a strength of at least 25 percent.

8. The method of claim 5 wherein the second aqueous soluble base is approximately 10 percent ammonium hydroxide.

9. The method of claim 8 wherein the step of treating the filtrate with a second aqueous base substantially removes oxalate ions.

10. The method of claim 5 wherein the step of dissolving the first solid uses ramenic malic acid.

11. The method of claim 5 wherein the step of dissolving the first solid uses approximately a 2:1 ratio of malic acid to $Nb_2O_5$.

12. The method of claim 5 wherein the step of dissolving the first solid uses a solution of approximately 0.1 moles per liter of malic acid.

13. The method of claim 5 wherein the step of stirring the solution is performed for approximately five hours at approximately 70 degrees Centigrade.

14. The method of claim 5 wherein the step of further stirring is performed for approximately two hours under a stream of nitrogen at 80 degrees Centigrade.

15. The method of claim 5 wherein the step of evaporating the solution is performed under a stream of nitrogen at approximately 80 degrees Centigrade.

16. The method of claim 15 wherein the step of evaporating the solution is performed substantially free of stirring and is performed until the second solid dry.

17. The method of claim 5 further including the step of heating the second solid.

18. The method of claim 17 wherein the step of heating the second solid is performed at approximately 550 degrees Centigrade for six hours.

19. A method of producing a cesium-137 gamma radiation source of claim 1, the method including the steps of:

adding a compound to a solution of oxalic acid, the compound being selected from the group consisting of $Nb_2O_5$ oxide pentahydrate, niobic acid, $Ta_2O_5$ and mixtures thereof;

stirring and heating the combination of the compound and oxalic acid to dissolve the compound;

filtering the combination of the compound and oxalic acid to produce a filtrate:

treating the filtrate with ammonium hydroxide to produce a precipitate;

washing the precipitate with ammonium hydroxide to produce a first solid;

dissolving the first solid in citric acid to create a solution;

heating the solution;

adding $^{137}Cs_2CO_3$ to the solution;

adding an alcohol to the solution;

further stirring the solution; and reducing the solution by evaporation, heating the solution to create a second solid, wherein the second solid is the solid radioactive component.

20. The method of claim 19 wherein in the step of adding the compound to a solution of oxalic acid, approximately a four to one (4:1) mass ratio of oxalic acid to the compound is used.

21. The method of claim 19 wherein the step of treating the filtrate with a first aqueous soluble base results in a pH of approximately 11, and wherein the aqueous soluble base is ammonium hydroxide with a strength of at least 25 percent.

22. The method of claim 19 wherein the second aqueous soluble base is approximately 10 percent ammonium hydroxide.

23. The method of claim 22 wherein the step of treating the filtrate with a second aqueous base substantially removes oxalate ions.

24. The method of claim 19 wherein the step of dissolving the first solid uses approximately a 3:1 ratio of citric acid to the compound.

25. The method of claim 19 wherein the step of stirring the solution is performed to approximately 80 degrees Centigrade.

26. The method of claim 19 wherein the step of adding alcohol to the solution adds ethylene glycol to the solution at approximately a 60:40 mass ratio of ethylene glycol to citrate.

27. The method of claim 19 wherein the step of further stirring is performed for approximately two hours under a stream of nitrogen at 110 degrees Centigrade.

28. The method of claim 19 wherein the step of evaporating the solution is performed under a stream of nitrogen at approximately 110 degrees Centigrade.

29. The method of claim 19 wherein the step of evaporating the solution is performed substantially free of stirring and is performed until no significant further reduction in volume is able to be realized.

30. The method of claim 19 further including the step of heating the second solid.

31. The method of claim 30 wherein the step of heating the second solid is performed in an oil bath at approximately 225-250 degrees Centigrade under a stream of nitrogen and then at approximately 550 degrees Centigrade for six hours.

* * * * *